United States Patent [19]

Miyamoto et al.

[11] 4,392,365

[45] Jul. 12, 1983

[54] APPARATUS FOR TREATING TEXTILE MATERIAL FOR CONTINUOUS LENGTH

[75] Inventors: Mitsuyasu Miyamoto, Itami; Osamu Ishimaru, Matsubara; Nobuyoshi Fukube, Takatsuki, all of Japan

[73] Assignee: Hisaka Works, Ltd., Osaka, Japan

[21] Appl. No.: 313,320

[22] Filed: Oct. 20, 1981

Related U.S. Application Data

[63] Continuation of Ser. No. 213,615, Dec. 5, 1980, abandoned, which is a continuation of Ser. No. 84,072, Oct. 12, 1979, abandoned.

[30] Foreign Application Priority Data

Oct. 18, 1978 [JP] Japan ..... 53-127265
Feb. 24, 1979 [JP] Japan ..... 54-23235

[51] Int. Cl.[3] ..... D06B 3/28

[52] U.S. Cl. ..... 68/19; 68/177; 68/184

[58] Field of Search ..... 8/152; 68/19, 177, 178, 68/184

[56] References Cited

U.S. PATENT DOCUMENTS 2,720,443 10/1955 Keggin ..... 8/152 X
3,587,256 6/1971 Spara ..... 68/178 X
3,780,544 12/1973 Turner et al. ..... 68/177
3,924,424 12/1975 Watanabe et al. ..... 68/177
3,952,558 4/1976 Sandberg et al. ..... 68/177
4,019,351 4/1977 Mizutani et al. ..... 68/177

FOREIGN PATENT DOCUMENTS 753362 12/1970 Belgium ..... 68/177
934645 11/1955 Fed. Rep. of Germany ..... 68/177
48-6431 2/1973 Japan ..... 68/177

*Primary Examiner*—Philip R. Coe
*Attorney, Agent, or Firm*—Robert E. Burns; Emmanuel J. Lobato; Bruce L. Adams

[57] ABSTRACT

Very efficient and economical treatment of textile material in a continuous loop can be carried out in an improved circular treating passageway comprised of a portion for allowing the transient residence of the textile material while transferring in an approximately horizontal position, but in a zigzag form, in a treating liquor and another portion for moving the textile material through a rapid flow of the treating liquid, wherein the residence portion is inclined so that the depth of the treating liquor increases gradually in the advancing direction of the textile material and a baffle plate is provided so that the textile material transferred with the rapid flow of the treating liquor strikes against the baffle plate at a high speed.

8 Claims, 4 Drawing Figures

APPARATUS FOR TREATING TEXTILE MATERIAL FOR CONTINUOUS LENGTH

This is a continuation of application Ser. No. 213,615, filed Dec. 5, 1980, now abandoned, and which was a continuation of application Ser. No. 084,072 filed Oct. 12, 1979 and now abandoned.

BACKGROUND OF THE INVENTION

1. Field of the Invention

The invention relates to apparatus for treating textile material which is in a continuous loop. More particularly, the invention relates to apparatus for the treatment, such as dyeing or scouring, of a textile material, such as knitted, woven or non-woven fabrics, which is in a continuous loop, and which involves circulating said textile material with a treating liquor.

2. Description of Prior Art

Jet treatment of textile material in an endless loop form is well known, wherein the textile material is treated by circulating the textile material together with a treating liquor while allowing the transient residence of the textile material in a bath, said bath being arranged in an approximately horizontal position.

In such jet treatment of a textile material, proposals have recently been made for making the treatment more efficient, whereby the circulation of the treating liquor and the textile material is carried out at a high speed (see, for example, Japanese Patent Publication No. 52-37112). By increasing the circulation speed of the treating liquor, as well as increasing the circulation speed of the textile material, the treating liquor is in more frequent contact with the textile material, so that the treating time decreases, thereby resulting in a more efficient operation. On the other hand, proposals have been made, for the purpose of economizing the treatment, whereby the amount of the treating liquor is decreased so that the treatment takes place with a low liquor ratio (see, for example, Japanese Laid-open Patent Specification (Kokai) No. 53-130369). The total volume of the treating liquor is decreased by inclining the bath, which lowers the liquor ratio so that the consumption of energy is decreased and the necessary amount of dyes or treating agents is also decreased which allows more economical treatment.

However, such a low liquor ratio treatment may have a drawback in that the textile material is not smoothly transferred in the bath due to the small volume of the treating liquor and, thus, it becomes difficult to obtain an even treatment of the textile material. Particularly, in the case where such a low liquor ratio treatment is applied when rapid treatment takes place, as mentioned above, the problem that the textile material is not smoothly moved through the bath makes it impossible to practically carry out such rapid treatment of the textile material. This is because a complex entanglement of the textile material occurs due to the unsmooth movement thereof in the bath, so that the treatment operation is often interrupted.

SUMMARY OF THE INVENTION

It is the primary object of the present invention to eliminate the above-mentioned problems in the jet treatment of textile material and to provide apparatus by which the jet treatment of textile material in a continuous loop can be carried out economically and efficiently at a low liquid ratio and at a high speed.

The above object and other objects which will become apparent from the descriptions given hereinbelow can be achieved by the apparatus of the present invention having the following construction.

The present invention provides an apparatus for treating a textile material in a continuous loop, comprising a circular treating passageway comprised of a laterally elongated bath for allowing the transient residence of the textile material while transferring the textile material in a treating liquor in a zigzag form, a section for jetting the treating liquor connected to the outlet portion of the residence bath, and a passageway for transferring the textile material along with a rapid flow of the treating liquor, said passageway having ends connected to the inlet portion of the bath and to the treating liquor jetting section, and a treating liquor circulating passageway leading to the treating liquor jetting section via at least one port for intaking the treating liquor provided in the bath, a suction pipe, a pump and a heat exchanger, characterized in that the bath is inclined so as to gradually increase the depth of the treating liquor in the advancing direction of the textile material and in that a baffle plate is provided at the inlet portion of the bath at a prescribed interval from the outlet end of the transferring passageway so that the textile material strikes against the baffle plate.

In the preferred embodiments of the above-mentioned apparatus of the present invention, some other means are introduced for making the movement of the textile material in the residence bath smoother and for attaining other advantageous effects as mentioned hereinbelow.

DESCRIPTION OF PREFERRED EMBODIMENTS

In the present invention, the rapid treatment of a textile material in a continuous loop, is made possible by moving the textile material with a rapid flow of a treating liquor and causing the textile material to strike against a baffle plate at the inlent portion of a bath, said baffle plate ensuring the smooth movement of the textile material in the bath and then from the bath to a conduit passageway in which the textile material is moved along with the treating liquor which is flowing rapidly. The smooth movement of the textile material is further promoted, according to the present invention, by the inclination of the bath so that the depth of the treating liquor gradually increases in the advancing direction of the textile material. Thus, in the present invention, since the movement of the textile material in the circular treating passageway can be made very smoothly, a low liquor ratio can also be achieved since the amount of the treating liquor can be easily decreased.

The present invention will now be explained in detail below, with respect to the preferred embodiments thereof, with reference to the accompanying drawings.

Figure 1:
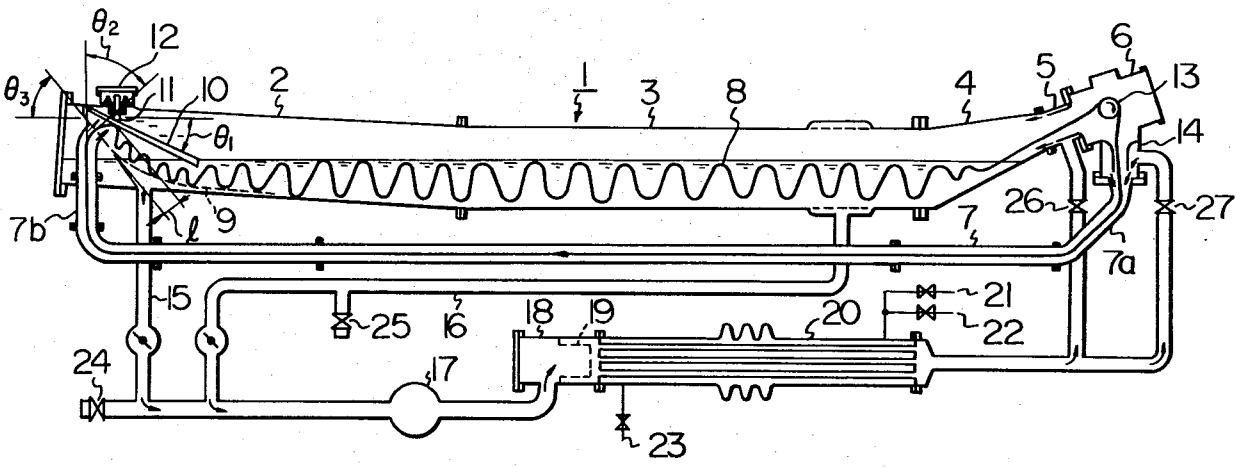
FIG. 1 is a cross-sectional view schematically illustrating a preferred embodiment of the apparatus of the present invention.

Referring now to FIG. 1, a residence bath 1 is composed of a rear portion 2, a middle portion 3 and a front portion 4. The rear portion 2 is inclined and the angle of the inclination is preferably not more than 5° with respect to a horizontal plane. The middle portion 3 is approximately horizontal and the front portion 4 is in a taper form and inclined at a greater angle than the rear portion. Connected to the front portion 4 are jetting section 5 for jetting the treating liquor in a direction opposite to the advancing direction of the textile material and a header section 6. The header section 6 is formed in an approximate T-shape and in the central portion thereof a guide roll 13 is provided while in the lower portion a section 14 for jetting the treating liquor is provided.

A transferring passageway 7 for rapidly transferring the textile material being treated is connected, at its inlet portion *7a*, to the lower end of the treating liquor jetting section 14 and is communicated, at its outlet portion *7b*, with the rear portion 2 of the bath 1 in such a manner that the outlet end of the passageway 7 is projected into the rear portion 2. The inlet portion *7a* is inclined and the angle of inclination is preferably from 30° to 60°.

A circular treating passageway is thus formed by the bath 1, a section 5 for jetting the treating liquor in a direction against the current, a header section 6 and a transferring passageway 7. The portion of the textile material 8 in the bath 1 is moved in such a manner that the textile material transiently stays within the bath in a zigzag form and is moved in the transferring passageway 7 in an approximately straight form.

In the inside of the rear portion 2 of the bath 1, a baffle plate 10 is provided so as to cover the open end of the outlet portion *7b* of the passageway 7 with a prescribed interval from the open end, so that the textile material coming out from the passageway 7 at a high speed directly strikes against the baffle plate. In the baffle plate many holes are formed and the major part of the treating liquor carried with the textile material is passed through the holes and separated from the textile material at the time when the textile material strikes against the baffle plate. It is preferable that the baffle plate 10 be inclined and, in the apparatus illustrated in FIG. 1, the angle of inclination of the baffle plate can be changed by a joint 11. Further, the interval between the baffle plate and the open end of the outlet portion *7b* of the passageway 7 is adjustable by means of a guide shaft 12. The position and the angle of inclination of the baffle plate 10 can be set as desired. However, it is preferable that the angle $\theta_1$, the distance and the angle $\theta_2$, as shown in FIG. 1, are in ranges of from 20° to 45°, from 100 mm to 150 mm and from 50° to 80°, respectively.

Figure 2:
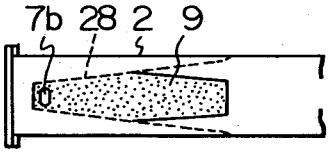
FIG. 2 is a schematical plan view illustrating the perforated plate portion of the apparatus illustrated in FIG. 1.

Below the baffle plate 10, an inclined perforated plate 9 is provided so that as the textile material 8 strikes against the baffle plate 10 it falls onto the perforated plate and, then, is advanced smoothly. The angle of inclination of the perforated plate 9 is preferably from 30° to 70° to the angle $\theta_3$ as shown in FIG. 1. At both sides of the perforated plate 9, a pair of plates 28 for preventing the textile material from moving in a zigzig direction is provided as shown in FIG. 2. The pair of plates is arranged to have an interval gradually increasing in the advancing direction of the textile material so that the textile material which falls onto the perforated plate is advanced without being entangled.

In the apparatus in FIG. 1, there are further provided suction pipes 15 and 16 for removing the treating liquor from the bath 1 via the intaking ports provided on the bath as well as a pump 17, a filter 18 with a wire net 19, a heat exchanger 20, a water feeding pipe 21, a steam feeding pipe 22, a drainage pipe 23 and regulating valves 24, 25, 26 and 27.

The operation of the apparatus will be illustrated below with reference to FIG. 1.

The textile material 8 comes out from the bath 1, is passed through the guide roll 13 and the treating liquor jetting section 14 and strikes against the wall of the inclined inlet portion *7a* of the passageway 7 by being carried with the jet flow of the treating liquor fed from the treating liquor jetting section 14 in the circular treating passageway. The inclination of the inlet portion *7a* can produce an impact effect on the textile material and, in addition, decrease the flow resistance of the rapid treating liquor flow produced by the treating liquor jetting section 14 to ensure a very high speed flow of the treating liquor. Thus, it is possible to move the running speed of the textile material being transferred in the passageway as high or higher than 300 m/min particularly 300 to 600 m/min.

Since the passageway 7 has a relatively small diameter, the textile material 8 passes through this passageway in an approximately straight form and strikes against the baffle plate 10 immediately after coming out from the outlet portion *7b*. At this time, the textile material gets an impact effect and, concurrently, the major part of the treating liquor carried with the textile material is passed through the holes formed in the baffle plate and separated from the textile material. The angle of inclination and the position of the baffle plate can be adjusted as desired as mentioned hereinabove and, thus, it is possible to effect the treatment of various types of textile materials by adjusting the angle of inclination and the position of the baffle plate depending upon the type, nature or the like of the textile material to be treated.

The perforated plate 9 is formed so as to gradually decrease the angle of inclination in the advancing direction of the textile material and, in addition, the plates 28 for preventing the zigzag movement of the textile material are arranged so as to gradually increase the interval therebetween. Therefore, the textile material falls onto the perforated plate 9 after striking the baffle plate 10 and is arranged in order and transferred forward successively and smoothly.

The textile material thus fed into the rear portion 2 of the bath 1 is then transferred from the middle portion 3 to the front portion 4, according to the advancing flow of the treating liquor, in a zigzagged mass form. The inclination of the rear portion 2, as hereinbefore mentioned ensures the smooth movement of the textile material and produces an advantageous effect in decreasing the required volume of the treating liquid in the bath 1.

The textile material 8 at the front portion 4 of the bath 1 is drawn up into the inside of the header section 6 through the guide roll 13. At the time the textile material 8 is drawn up, the textile material is subjected to the action of the countercurrent flow of the treating liquor produced by the section 5 for jetting the treating liquor in the countercurrent direction to loosen the possible entanglement of the textile material, whereby the textile material can again be smoothly guided to the treating liquor jetting section 14.

Since the header section 6 is arranged, by the inclination of the front portion 4, so as to take a position higher than the level of the treating liquor in the residence bath, the guide roll 13 becomes located in a gaseous area; thereby, the rapid movement of the textile material in this section can easily be achieved.

It is preferable that the level of the treating liquor in the residence bath is set so as to be at the middle level of the middle portion 3. In such a condition, since the striking against the baffle plate 10 and the falling onto the perforated plate 9 is carried out within a gaseous area, the separation of the textile material from the treating liquor is effected very efficiently and produces a high impact effect on the textile material and the entanglement of the textile material being treated is effectively avoided.

The treating liquor taken out from the intaking ports of the bath 1 is forwarded to the pump 17 via the suction pipes 15 and 16 and, then, passed through the filter 18 and heated by the heat exchanger 20. Then, a part of the treating liquor is fed to the treating liquor jetting section 14 via the regulating valve 27 and the remaining liquor is fed to the section 5 for jetting the treating liquor in the countercurrent direction via the regulating valve 26.

Figure 3:
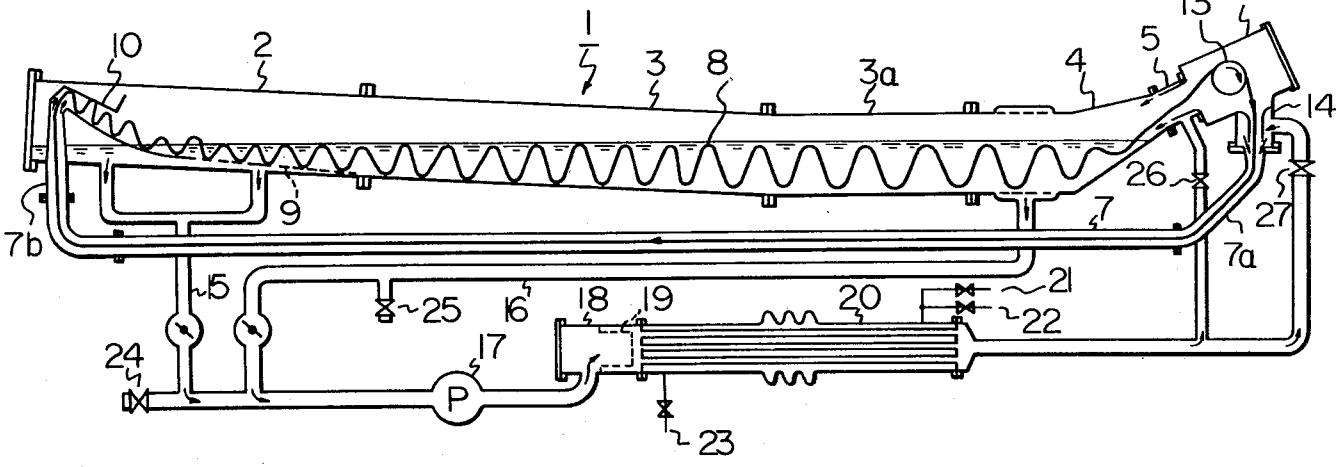
FIG. 3 is a cross-sectional view schematically illustrating another preferred embodiment of the apparatus of the present invention.

In the apparatus illustrated in FIG. 3, the baffle plate 10 is fixed. In this apparatus, the middle portion of the bath is composed of two parts 3 and 3*a*, in which the part 3 is inclined at an angle substantially the same as that of the rear portion 2, whereby the smooth movement of the textile material in the bath and the decrease of the liquid ratio can be attained more effectively.

Figure 4:
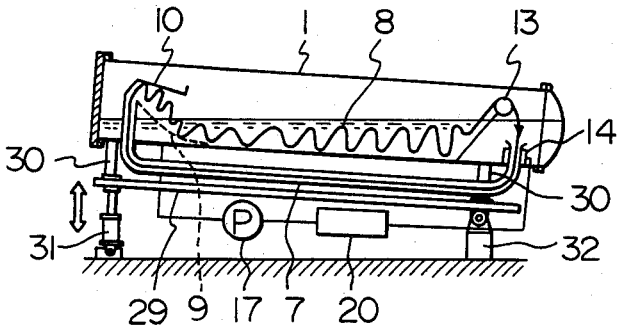
FIG. 4 is a cross-sectional view schematically illustrating a further embodiment of the apparatus of the present invention.

In the apparatus illustrated in FIG. 4, the bath 1 is formed in one body and the baffle plate 10 is fixed as in the apparatus illustrated in FIG. 3. This apparatus has means for properly adjusting the inclination of the bath 1 depending upon the temperature of the treating liquor, the type of the textile material or the like. The bath 1 is supported by a trestle 29 through legs 30 and a side of the trestle positioned at the inlet side of the residence bath is supported by a lifting mechanism 31 such as an air cylinder, hydraulic cylinder or jack. The lifting mechanism 31 can be moved upward and downward and stopped at a desired position. The other side of the trestle is supported on a prop 32, the upper portion of which is pivotable around a pivoted shaft. Thus, the residence bath can be inclined at a desired angle by the action of the lifting mechanism 31. The treating liquor circulating passageway including the pump 17 and the heat exchanger 20 may be fixed independently of the inclining movement of the residence bath or may be designed so as to be able to incline corresponding to the inclination of the residence bath.

In the embodiments illustrated above, the transferring passageway 7 is provided below the residence bath 1. However, if desirable or appropriate, the passageway 7 may be provided above the bath 1.

According to the method and apparatus of the invention as illustrated hereinabove, it is possible to practice the very efficient rapid treatment of textile material in a continuous loop and, also, the economical treatment of such textile material at a low liquor ratio. The smooth movement and the rapid transfer of the textile material in the present invention makes it possible to produce uniform treatment on the textile material owing to the increased contact of the treating liquor with the textile material. Further, since the textile material receives a beating effect when striking against the baffle plate, it is unlikely that wrinkles in the textile material will become fixed. Furthermore, in the present invention, it is possible to carry out the relaxing of knitted or woven fabrics made from a textured yarn or the creping of woven fabrics made from a high twist yarn very effectively, through the impact effect obtainable at the time when the material strikes against the baffle plate. Accordingly, the method and apparatus of the present invention may be utilized for general purpose treatments.

What is claimed is:

1. An apparatus for treating a textile material in a continuous loop form, comprising a circular treating passageway comprised of a laterally elongated bath for allowing transient residence of the textile material while transferring the textile material in a zigzag form in a treating liquor, the level of said treating liquor being kept below half of the depth of the residence bath, a section for jetting the treating liquor connected to an outlet portion of the residence bath, and a passageway located generally below the bath for transferring the textile material along with a rapid flow of the treating liquid and having an outlet end connected to an inlet portion of the bath and an inlet end connected to an outlet portion of the treating liquor jetting section, at least one port for intaking the treating liquor provided in the bath, a suction pipe communicating with the port, a pump connected to the suction pipe for discharging treating liquor to the treating liquor jetting section and a heat exchanger downstream of the pump, characterized in that the residence bath is inclined so as to gradually increase the depth of the treating liquor in the advancing direction of the textile material, a baffle plate provided at the inlet portion of the bath above the level of the treating liquor at a prescribed interval of distance from the outlet end of the transfer passageway disposed so that the textile material strikes against the baffle plate above the level of the treating liquor in the bath, and a perforated plate is provided, with an inclination, below the baffle plate and on to which the textile material is deflected by the baffle plate for smooth advancement of the textile material.

2. An apparatus according to claim 1, wherein the baffle plate is perforated to effectively separate the major part of the treating liquor carried with the textile material from the textile material as it strikes the baffle plate.

3. An apparatus according to claim 1, wherein a section for jetting the treating liquor in a counter-current direction with respect to the advancing direction of the textile material is provided between the outlet portion of the residence bath and the inlet portion of the treating liquor jetting section and the section for jetting the treating liquor in the counter-current direction is connected to a branch of the treating liquor circulating passageway provided between the heat exchanger and the treating liquor jetting section.

4. Apparatus for treating a textile material in a loop comprising, means for containing a treating bath of a treating liquor for treating material therein while travelling longitudinally and immersed therein, the bath being elongated to define a period of residence of the textile material therein, means to take a suction on the bath and recirculate the treating liquor back to the bath, means defining an elongated passageway located generally below the bath for receiving the textile material upon leaving from the bath and for receiving treating liquor being recirculated back to the bath as a jet flow to effect travel of the textile material through the passageway at a linear velocity greater than the velocity of travel thereof through the treating bath, means to develop a jet flow of the treating liquor through the passageway, means comprising a perforated baffle above the level of the bath for removing the treating liquor from the textile material upon impact of the textile material thereon, said passageway terminating in an outlet above the level of the treating bath for ejecting of the longitudinally travelling textile material against the baffle at a velocity for effecting an impact on the perforated baffle by the longitudinally travelling textile material effective to remove the treating liquor therefrom, and said perforated baffle being inclined relative to the vertical and having an inpact portion inclined toward the direction of travel of the longitudinally travelling textile material so that the travelling textile material impacts thereon and is deflected into the treating bath without entangling thereof.

5. Apparatus for treating a textile material in a loop according to claim 4, in which said passageway outlet in close to said perforated baffle.

6. Apparatus for treating a textile material in a loop according to claim 4, including means to vary the inclination of the baffle plate relative to the vertical.

7. Apparatus for treating a textile material in a loop according to claim 4, in which said means to recirculate includes a heat exchanger for applying heat to the treating liquor before return back to the treating bath.

8. Apparatus for treating a textile material in a loop according to claim 4, including a perforated plate in said bath on to which the travelling textile material is deflected by said perforated baffle, and said perforated plate being inclined from the horizontal to assist the textile material to travel smoothly and without entangement.

* * * * *